United States Patent [19]

Nakano et al.

[11] Patent Number: 4,640,236

[45] Date of Patent: Feb. 3, 1987

[54] LIQUID-COOLED CYLINDER ASSEMBLY IN INTERNAL-COMBUSTION ENGINE

[75] Inventors: Hideaki Nakano, Akashi; Tadahiro Ozu, Kobe, both of Japan

[73] Assignee: Kawasaki Jukogyo Kabushiki Kaisha, Kobe, Japan

[21] Appl. No.: 780,077

[22] Filed: Sep. 25, 1985

[51] Int. Cl.[4] ..... F01P 3/02

[52] U.S. Cl. ..... 123/41.79; 123/41.84; 123/193 CH

[58] Field of Search ..... 123/41.83, 81.84, 193 C, 123/193 CH, 193 CP, 41.79; 92/171

[56] References Cited

U.S. PATENT DOCUMENTS 1,968,449 7/1934 Hefi ..... 123/41.83

3,659,569 5/1972 Mayer et al. ..... 123/41.84

FOREIGN PATENT DOCUMENTS 59-70855 4/1984 Japan ..... 123/193 C

*Primary Examiner*—William A. Cuchlinski, Jr.

*Attorney, Agent, or Firm*—Wenderoth, Lind & Ponack

[57] ABSTRACT

A cylinder assembly in an internal-combustion engine having a cylinder liner is provided with a reinforcing ring shrunk fitted around the upper end part of the liner and provided with liquid passages communicating with respective recesses grooved in the outer surface of the upper end part of the liner, thereby forming cooling liquid passageways of a cooling system. This construction affords high strength of the cylinder assembly and remarkably effective cooling performance thereof, which make possible the production of engines of extremely high performance.

6 Claims, 5 Drawing Figures

LIQUID-COOLED CYLINDER ASSEMBLY IN INTERNAL-COMBUSTION ENGINE

BACKGROUND OF THE INVENTION

This invention relates generally to internal-combustion engines of piston type and cylinder assemblies thereof and more particularly to an internal-combustion engine cylinder assembly having a cylinder head and a cylinder liner and further provided with a reinforcing ring tightly fitted around the upper or cylinder-head-end part of the liner and having cooling liquid passages communicating with respective recesses grooved in the outer cylindrical surface of the liner to form cooling liquid passageways of a cooling system.

As the output power of piston-type internal-combustion engines increases as in recent years, the temperatures of sliding parts of the engine such as those of the piston and cylinder liner become ever higher, and the temperature of the lubricating oil interposed between the piston rings and the cylinder also becomes higher, whereby it has become increasingly difficult to form a lubricating oil film between such sliding parts. One obvious solution of this problem is to provide ample cooling of the cylinder liner, but this is difficult to achieve with a conventional cylinder assembly of the type comprising a cylinder liner and a cylinder jacket encompassing the cylinder liner with a space formed therebetween for passage of a cooling liquid as described more fully hereinafter.

In another conventional type of cylinder assembly, numerous cooling liquid passageways are formed in the upper part of the cylinder liner, which in this upper part has a relatively large outer diameter and thus has a greater wall thickness than the lower or skirt part thereof. The liquid passageways, however, lower the mechanical strength of the linear and give rise to cracks therein in some instances. To overcome this problem, the outer diameter of the outer part of the liner can be increased, but this measure would make the cylinder structure bulky and increase the material cost.

SUMMARY OF THE INVENTION

It is an object of this invention to provide in an internal-combustion engine an improved cylinder assembly having ample mechanical strength and, moreover, being effectively cooled even in the case where the engine is of high output power type.

According to this invention, briefly summarized, there is provided, in an internal-combustion engine of piston type having at least one cylinder assembly comprising a cylinder head and a cylinder liner capped at the upper end thereof by the cylinder head, the improvement which comprises: a reinforcing ring fixedly fitted around the outer cylindrical surface of the upper end part of the cylinder liner; a plurality of recesses grooved in and at respective positions around said outer cylindrical surface; a plurality of passagesways formed in the reinforcing ring and communicating with respective said recesses to form cooling-liquid passageways; and means for preventing relative displacements between the cylinder head, the cylinder liner, and the reinforcing ring.

The nature, utility, and further features of this invention will be more clearly apparent from the following detailed description with respect to preferred embodiments thereof when read in conjunction with the accompanying drawings, briefly described below.

Throughout this disclosure, the direction indicated by the term "upper" is that from the cylinder liner toward the cylinder head.

DETAILED DESCRIPTION OF THE INVENTION

Figure 4:
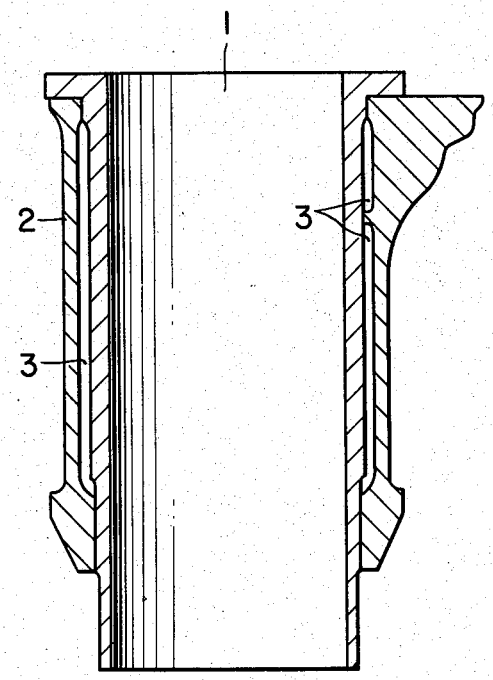
PRIOR ART FIG. 4
FIG. 4 is an axial section showing one example of a known cylinder assembly.
Figure 5:
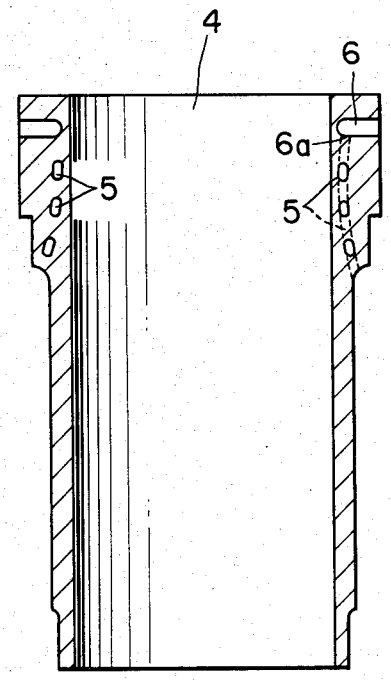
PRIOR ART FIG. 5
FIG. 5 is an axial section showing another example of a known cylinder assembly.

As conductive to a full understanding of this invention, the general nature, attendant problems, and limitations of conventional cylinder liner cooling means will first be described with respect to two typical examples as illustrated in FIGS. 4 and 5.

FIG. 4 shows in vertical section a cylinder liner 1 generally used heretofore in internal-combustion engines for medium- to high-speed operation. This cylinder liner 1 is of integrated construction fabricated by casting, which affords good sliding action between this liner and the piston rings and piston (not shown). The outer cylindrical surface of the liner 1 is encompassed and covered by a cylinder jacket 2, a cooling liquid passageway 3 being formed therebetween.

Although cooling of the liner 1 is provided in this cylinder assembly of conventional structural arrangement, it is inadequate for overcoming the difficulty of forming lubricating oil film between the sliding parts of the piston-cylinder mechanism of modern engines of high performance, as was mentioned briefly hereinbefore.

In another cylinder assembly of improved cooling performance used heretofore and illustrated in FIG. 5, the cylinder liner 4 has an upper end part of enlarged outer diameter, in which a large number of cooling liquid passageways 5 are formed. The formation of these passageways 5 within the cylinder liner 4 reduces the strength thereof. This lowering of the strength of the liner 4 occurs particularly in the vicinity of the junctions **6*a* between the passageways 5 extending in the axial direction of the liner 4 and a passageway 6 extending in the circumferential direction through the upper part of the liner 4 and communicating with the passageways 5, whereby cracks tends to occur in the vicinity of the junctions 6*a*** to give rise to a new problem.

As stated briefly hereinbefore, this problem becomes serious with increasing power output of modern internal-combustion engines, which entails increase in the pressure acting on the inner wall surface of the liner 1 or 4 due to combustive explosion in the cylinder. Accordingly, in the above described conventional cylinder assemblies, the walls of the cylinder liner 1 or 4 must be made extremely thick. This measure, however, results in an inordinately bulky cylinder structure and the use of much liner material.

In view of the difficulties accompanying conventional cylinder assemblies as described above, this invention seeks to provide an improved cylinder assembly of high mechanical strength which can be effectively cooled.

Figure 1:
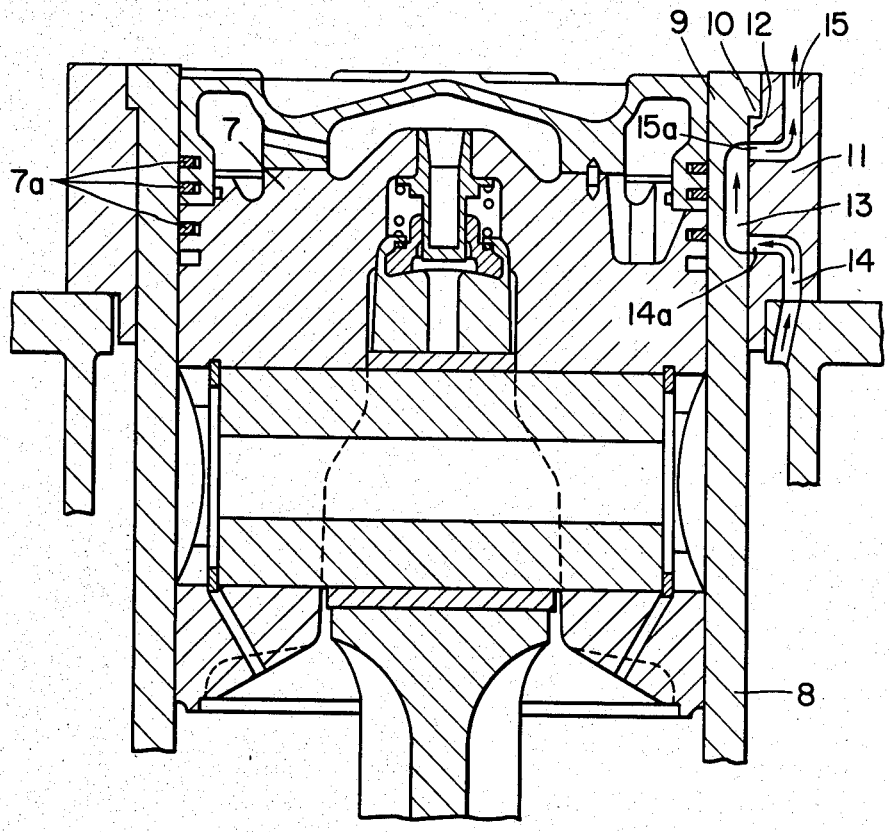
FIG. 1 is an axial section of one form of a cylinder assembly according to this invention.

In one embodiment of this invention as illustrated in FIG. 1, the cylinder assembly includes a cylinder liner 8 in which a piston 7 provided with piston rings *7a* is slidably fitted. The cylinder liner 8 is made of cast iron for establishing a good sliding engagement between its inner wall surface and the piston rings *7a*. This liner 8 is provided around its upper end 9 or its end nearest the cylinder head (not shown) with a flange-like projection or stepped part 10. Around the upper end 9 is fitted a reinforcing ring 11 having a stepped part 12 with a ledge corresponding to and abutting against the lower ledge of the stepped part 10 of the liner 8. The liner 8 is thereby positively supported against downward displacement away from the cylinder head by the reinforcing ring 11, which is securely fixed to the cylinder head and the cylinder block.

The reinforcing ring 11 is fabricated from a steel of higher strength than cast iron and functions to reinforce the upper part of the liner 8 against radially outward deformation thereby to enable the upper part to withstand the high pressure of combustive explosion within the cylinder. This reinforcing ring 11 is fitted onto the liner 8 by shrinkage fitting or by expansion fitting. Therefore, a radially inward compressive force is imparted to the liner 8, that is, the liner 8 is prestressed in compression. As a result, the radially outward stress, or hoop stress, imparted to the liner 8 by the combustion pressure within the cylinder is greatly reduced.

Prior to assembly, the outer circumferential surface of the upper part of the cylinder liner 8 and the inner surface of the reinforcing ring 11 are treated to prevent rusting by a procedure such as the tufftride process, nickel plating, or chrome plating thereby to prevent rusting due to possible infiltration of cooling water therebetween.

Figure 2:
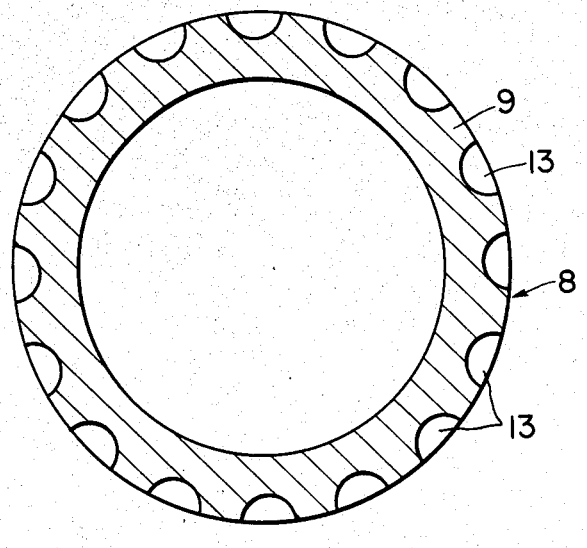
FIG. 2 is a cross section taken along a plane indicated by line II—II in FIG. 1.

As illustrated also in FIG. 2, the outer peripheral surface of the upper part of the liner 8 is provided therearound with a plurality of spaced-apart grooves 13 of finite length extending in the axial direction and facing the inner surface of the ring 11. Each groove 13 may be of semi-circular cross-sectional shape and communicates at its lower and upper ends respectively with the upper end and lower end of L-shaped cooling fluid passageways 14 and 15 formed in the reinforcing ring 11. Each passageway 14 has a cooling fluid supply opening 14*a* facing the groove 13, and each passageway 15 a cooling fluid discharge opening 15*a* facing the groove 13. The grooves 13 can be readily formed since they are along the outer peripheral surface of the liner 8 and are outwardly open. Furthermore, although cooling liquid passageways 14 and 15 are formed in the reinforcing ring 11, the strength of this reinforcing ring is not appreciably lowered because these passageways are separate from one another and are not directly interconnected and also because the ring 11 is made of a steel of high strength.

Thus, the cylinder assembly of the above described construction and arrangement affords ample cooling of the cylinder liner 8, particularly at its critical upper part, and, moreover ample strength of this upper part to resist the repeated stress load due to the combustion pressure in the cylinder. Therefore the cylinder assembly of the invention can be applied to modern engines of high output power.

Figure 3:
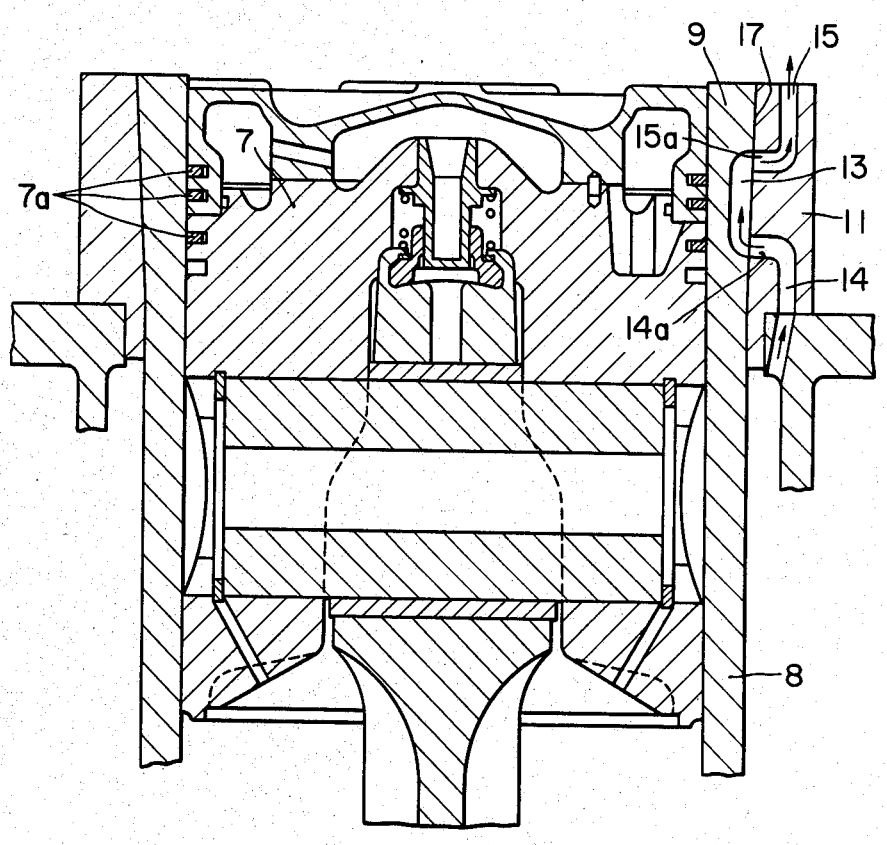
FIG. 3 is an axial section of another form of a cylinder assembly of the invention.

Another embodiment of this invention is illustrated in FIG. 3, in which those parts which are the same as or equivalent to corresponding parts in FIGS. 1 and 2 are designated by like reference numerals. In this embodiment, the outer cylindrical surface 17 of the upper part 9 of the cylinder liner 8 is so formed that its diameter increases gradually upward or toward the cylinder head, whereby it is substantially of an inverted frustoconical shape. The corresponding inner wall surface of the reinforcing ring 11 is so formed that it fits tightly around the upper end part 9 of the liner 8 in a leak-proof manner. The reinforcing ring 11 is fixed relative to the cylinder head (not shown). This construction of the cylinder assembly also positively prevents the cylinder liner 8 from separating away from the cylinder head in the downward direction when subjected to the combustion pressure within the cylinder.

Thus, as described above with respect to representative embodiments, this invention provides a cylinder assembly in which the cooling of the cylinder liner is greatly improved, and, moreover, the strength of the cylinder liner is remarkably decreased by the reinforcing ring. Accordingly, this invention makes possible increases in the output power of internal-combustion engines without resorting to the expensive and undesirable measure of inordinately increasing the wall thickness of the cylinder liner. Furthermore, the fabrication of the cylinder liner and the reinforcing ring is simplified and facilitate by the arrangement of the cooling liquid passages wherein recesses are formed on the outer cylindrical surface of the liner and cooling liquid passages to communicate with these recesses are formed in the reinforcing ring, whereby the production cust is reduced.

What is claimed is:

1. An internal-combustion engine of the piston type having at least one cylinder assembly comprising a cylinder head and a cylinder liner capped at the upper end thereof by the cylinder head, the improvement comprising: a reinforcing ring fixedly fitted around the outer cylindrical surface of the upper end part of the cylinder liner; a plurality of recesses grooved in and at respective positions around said outer cylindrical surface; a plurality of passageways in the reinforcing ring and communicating with respective said recesses to form cooling-liquid passageways; said upper end part of the cylinder liner having an inverted frustoconical shape with the outer diameter thereof increasing gradually in the direction toward the cylinder head, and the inner wall surface of the reinforcing ring formed to fit tightly around said upper end part in a leak-proof manner for preventing relative displacements between the cylinder head, the cylinder liner, and the reinforcing ring.

2. An internal-combustion engine of the piston type having at least one cylinder assembly comprising a cylinder head and a cylinder liner capped at the upper end thereof by the cylinder head, the improvement comprising: a reinforcing ring fixedly fitted around the outer cylindrical surface of the upper end part of the cylinder liner; a plurality of recesses grooved in and at respective positions around said outer cylindrical surface, said recesses in the cylinder liner aligned substantially parallel to the axial direction of the liner; a plurality of passageways in the reinforcing ring and communicating with respective said recesses to form cooling-liquid passageways; and means for preventing relative displacements between the cylinder head, the cylinder liner, and the reinforcing ring.

3. The improvement as claimed in claim 2 in which said recesses have a semi-circular cross-sectional shape when taken in the direction transverse to the longitudinal axis of the liner.

4. The improvement as claimed in claim 2 in which said means for preventing relative displacements comprises a flange-like stepped part formed integrally with and projecting radially outward from said upper end part of the cylinder liner to form an annular first ledge, and a stepped part formed integrally with and projecting radially inward around the inner wall surface of the reinforcing ring to form an annular second ledge which abuts against said first ledge in a manner for positively locking the cylinder liner against the reinforcing ring.

5. In an internal-combustion engine of the piston type having at least one cylinder assembly comprising a cylinder head and a cylinder liner capped at the upper end thereof by the cylinder head, the improvement comprising: a reinforcing ring fixedly fitted around the outer cylindrical surface of the upper end part of the cylinder liner; a plurality of recessses grooved in and at respective positions around said outer cylindrical surface; a plurality of passageways in the reinforcing ring and communicating with respective said recesses to form cooling-liquid passageways, said passageways comprised of first passageways each having a cooling liquid supply opening facing one of the recesses for introducing cooling liquid thereinto and second passageways each having a cooling liquid discharge opening facing one of the recesses for carrying away cooling liquid therefrom; and means for preventing relative displacements between the cylinder head, the cylinder liner, and the reinforcing ring.

6. The improvement as claimed in claim 5 in which said first and second passageways extend substantially in parallel to the longitudinal axis of the liner.

* * * * *